United States Patent [19]

Gamberini

[11] Patent Number: 4,772,350

[45] Date of Patent: Sep. 20, 1988

[54] DEVICE FOR SPLICING THE LEADING AND TRAILING ENDS OF A NEW AND USED-UP ROLLS OF STRIP MATERIAL

[75] Inventor: Antonio Gamberini, Bologna, Italy

[73] Assignee: G.D Societa per Azioni, Bologna, Italy

[21] Appl. No.: 908,655

[22] Filed: Sep. 18, 1986

[30] Foreign Application Priority Data

Oct. 11, 1985 [IT] Italy ..... 3572 A/85

[51] Int. Cl.[4] ..... B65H 69/06; B65H 69/08

[52] U.S. Cl. ..... 156/366; 156/159; 156/504

[58] Field of Search ..... 156/157, 159, 64, 502, 156/504, 366, 378; 242/56 R, 58.1, 58.4, 58.5

[56] References Cited

U.S. PATENT DOCUMENTS

| | | | |
|---|---|---|---|
| 3,072,354 | 1/1963 | Giles et al. | 242/58.4 |
| 3,398,911 | 8/1968 | Poupin | 242/58.4 |
| 3,473,994 | 10/1969 | Levenson, Jr. | 156/504 |
| 3,565,731 | 2/1971 | Schmermund | 156/504 |
| 3,580,757 | 5/1971 | Niepmann | 156/504 |
| 3,886,031 | 5/1975 | Taitel | 156/504 |

*Primary Examiner*—Michael Wityshyn

*Attorney, Agent, or Firm*—Cushman, Darby & Cushman

[57] ABSTRACT

The device disclosed serves to splice the trailing end of packaging strip wound off a used-up roll to the leading end of a new roll, and comprises heated pressure rollers that bond the two ends of the strips, plates that guide the leading end of the new strip about to be bonded, and a sensing wheel that detects proximity of the leading edge of a new strip when fed into the guide plates. The trailing end of the used-up strip is cut by a blade located upstream of the guide plates, and a timer is used to set the operating time lapse of the pressure rollers according to the length of the splice as established by the stroke of the blade.

7 Claims, 3 Drawing Sheets

2
4
5
6
26
24
19
20
2
21
2
8
14
11
12
10
15
16
17
9
18
7

1
2
4
2
5
19
20
6
26
21
2
8
23
24
25
14
13
11
12
3
9
10
22
15
16
17
9
18
7

DEVICE FOR SPLICING THE LEADING AND TRAILING ENDS OF A NEW AND USED-UP ROLLS OF STRIP MATERIAL

BACKGROUND OF THE INVENTION

The invention disclosed relates to a splicer device for joining the trailing end of a used-up roll of strip with the leading end of a new roll.

The art field in question is that embracing packaging machinery, and in particular, machines such as are used for wrapping cigarettes.

Paper strip or thermoplastic film serving to envelop the product is purchased in rolls, often of considerable dimensions, and to avoid halting production whenever the roll of film or paper runs out, packaging machines of the type are generally provided with a device that carries two rolls; one of the rolls is used to supply a cutting device with strip material for packaging, the strip being severed into discrete lengths for infeed to the wrapping equipment, whilst the remaining roll provides a reserve supply, ready to be fed into the line once the first roll has run out.

In prior art packaging machines which make use of such materials, the replacement of the supply roll with a new roll is generally accomplished by splicing the trailing end of the strip wound off the supply roll, with the leading end of a new roll.

One method of producing a splice consists in inserting a length of tape, gummed on both sides, between the two overlapping strips, and pressing the three components firmly into contact in order to obtain a solid bond.

With the splice effected, one avoids any break in continuity of the supply of wrapping material to the packaging machine, since it is the selfsame trailing end of the strip wound off the old supply roll, now used up, that draws the leading end of the new roll of strip toward the cutting device.

A product which happens to be wrapped in the length of material comprising the splice will be discarded ultimately by the machine.

Such devices for splicing the ends of strip material nevertheless present certain drawbacks due to the fact that the area of the strips effectively bonded represents only a limited part of the actual stretch through which the material overlaps; as a result, the leading end of the new strip can fold over and stick when proceeding toward the work area, causing obstruction to the smooth passage of the material.

A second drawback arises in those instances where the cutting means which divide the strip into discrete lengths happen to effect the cut at a point in which the two strips overlap but are not bonded; this signifies that a sliver of the strip material will be separated totally and may fall onto the packaging line, occasioning a impediment to smooth operation of the machine.

The object of the invention is that of embodying a device for splicing strip in heat-sealable material, that will not give rise to the drawbacks described above.

The difficulty which the invention sets out to overcome is that of ensuring that the two spliced strips will be bonded together through their entire overlapping stretches; accordingly, there will be no loose flaps that can fold back, or become severed into slivers that fall onto the packaging line.

SUMMARY OF THE INVENTION

The stated object is realized with a device according to the invention, which serves to splice the leading and trailing ends of new and used-up rolls of strip material.

Such a device comprises pressure means for bonding the two ends of the spliced strips means for guiding the leading end of the new strip fed toward the pressure means, means for detecting proximity of the leading edge of the new strip fed into the guide means, means for drawing the pressure means together such that the overlapping spliced ends of the strip material are compressed between them, means, located upstream of the guide means, for cutting the trailing end of strip, and timing means for setting the operating time lapse of the pressure means according to the length of the spliced trailing end as established by the cutting means.

BRIEF DESCRIPTION OF THE DRAWINGS

The invention will now be described in detail by way of example, with the aid of the accompanying drawings, in which.

DESCRIPTION OF THE PREFERRED EMBODIMENT

Figure 1:
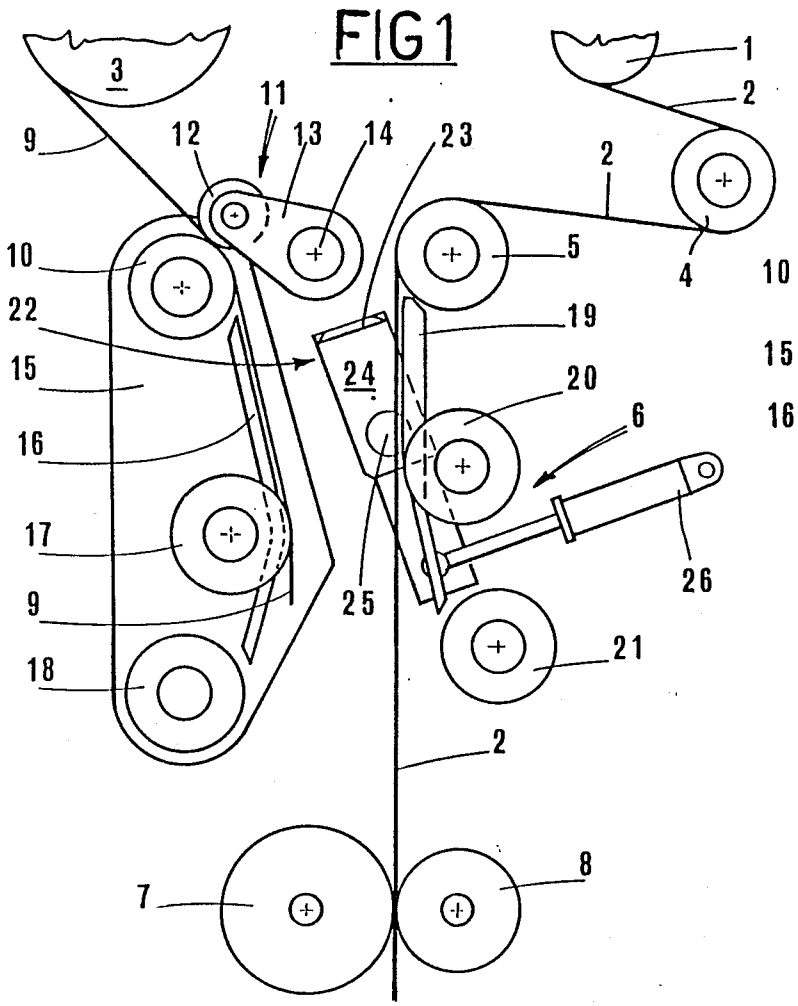
FIG. 1 is a schematic side elevation of the splicer device seen in the at-rest position during the stage in which strip is wound off the supply roll.
Figure 4:
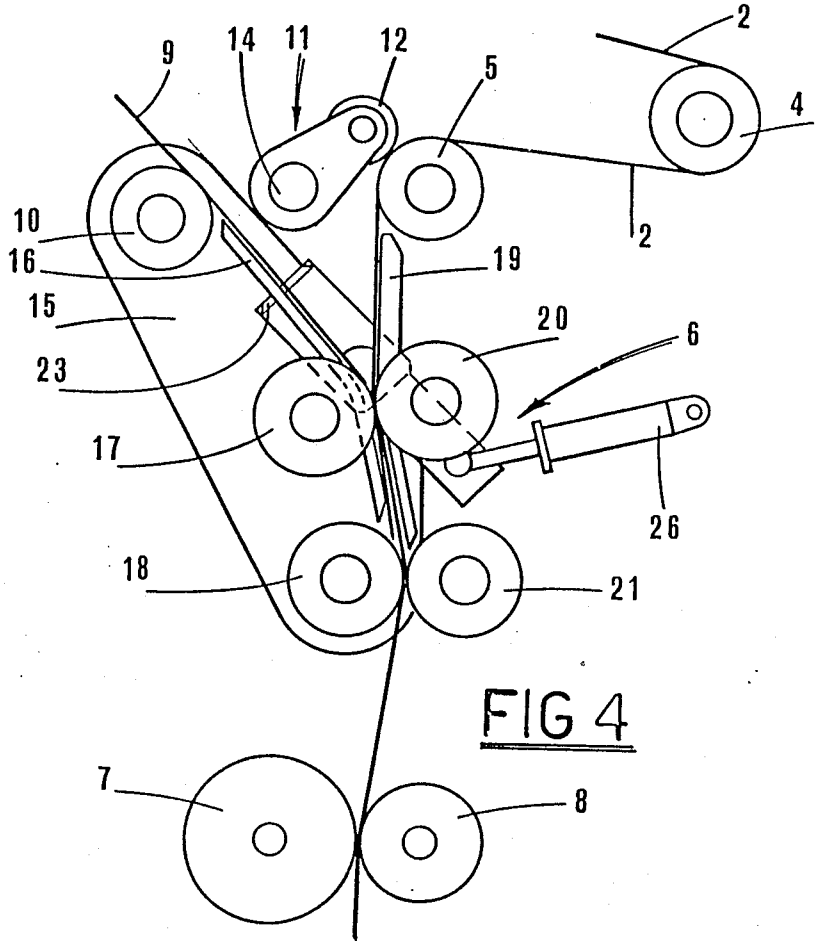
FIG. 4 is the same view as in FIG. 1, showing the device in its working position during the stage in which the leading end of a further roll is spliced.

With reference first to FIG. 1 of the drawings, 1 denotes a roll of thermoplastic strip material 2 currently in use and about to run out; 3 denotes a new roll that will replace the first roll 1 marginally before the end of the strip 2 is reached.

Both rolls 1 and 3 are carried in conventional manner by the frame of a packaging machine (not illustrated).

The strip 2 is wound off the roll 1 by a plurality of power driven and idle rollers of which two only 4 and 5 are shown, in the interests of simplicity.

Once past the drive roller 5, the strip 2 reaches a device, denoted 6 in its entirety, serving to splice together the leading and trailing ends of the two rolls 3 and 1 of strip, and passes thereafter between two pinch rollers 7 and 8.

The strip 9 wound off the new roll 3 passes through a set of drive and idle rollers (not illustrated), and is fed over a roller, denoted 10, and into the device 6.

The device 6 comprises sensing means 11 that detect proximity of the leading edge of the strip 9 fed into guide means (described below). The sensing means 11 consist substantially in an idle wheel 12 journalled to an arm 13 which is pivoted about a hinge pin 14 in such a way that the wheel 12 can be positioned in contact either with the roller denoted 10 or with the roller denoted 5.

The sensing wheel 12 can either be positioned manually by the machine operator, during set-up of the device 6 in readiness for the changeover of a roll, or flipped automatically at the moment of fitting a new roll, and its function is that of enabling commencement of a splice and roll-change operation only when the leading end of the new roll is positioned correctly for bonding to the trailing end of the roll currently running out.

The device 6 comprises means for guiding the leading end of the new strip 9 into the splice. Such guide means consist substantially in a support 15 which is pivoted about the axis of the shaft of the roller 10 aforementioned and carries a guide plate 16, an idle roller 17, and a further roller 18 that forms a part of the pressure means (described below) by which the spliced ends of the two strip 2 and 9 are bonded together.

19 denotes a fixed plate, located opposite the pivoted plate 16; 20 denotes an idle roller 20 projecting from the fixed plate 19; and 21 denotes a heated idle roller which, together with the roller denoted 18, constitutes the pressure means by which the two spliced ends of the strips 2 & 9 are bonded.

Rotation of the support 15 about the axis of the roller 10 occasions contact between the two rollers denoted 17 and 20, and between the two rollers denoted 18 and 21; the leading edge of the new strip 9 is thus brought into overlapping contact with the strip 2 currently drawn through the rollers, whereupon the new strip is drawn likewise through the rollers.

22 denotes cutting means, located at a point prior to the entry of either strip into the guide means which consist substantially in a serrated blade 23 carried by an arm 24 that pivots about a hinge pin 25 and is operated by a double acting cylinder 26.

Figure 6:
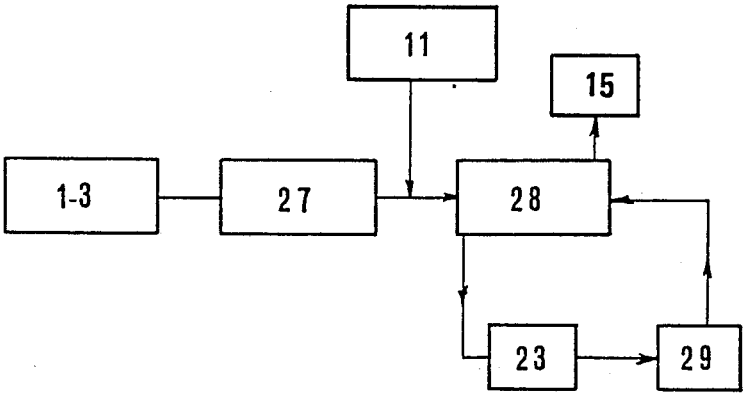
FIG. 6 is a block diagram of the device's control apparatus.

Operation of the device is such that when the roll 1 currently in use has dwindled to a given diameter, detected by a transducer denoted 27 in the block diagram of FIG. 6, and the sensing means detect proximity of the leading edge of the new strip 9 between the wheel 12 and the roller 10, the support 15 will rotate about the axis of the roller 10 and thus bring the one strip 9 into overlapping contact with the other strip 2. Shift of the support is produced by a solenoid valve 28 (not illustrated in the drawings of the device, but indicated in the block diagram of FIG. 6) to which the cylinder 26 is also connected.

It will be observed that the leading edge of the strip 9 must be positioned beyond the roller 17 but prior to the pressure means 18 and 21 in such a way that, when the pressure means are brought together, the leading end of the one strip 9 is drawn through the pressure means by the trailing end of the other strip 2; one thus ensures a secure bond of the two spliced strips 2 and 9 through their entire overlapping stretches.

Operation of the blade 23 will occur at a given moment following shift of the support 15, so as to ensure the bond of a given stretch of the over lapping strips 2 and 9; with the cut effected, the blade 23 stays put in the position assumed.

Figure 5:
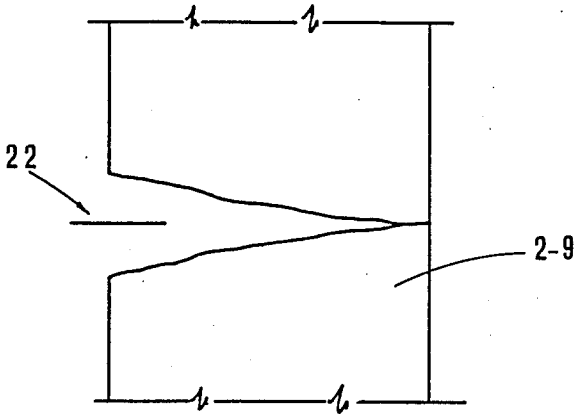
FIG. 5 illustrates schematically how the cut is performed on the trailing end of the strip material.

The support 15 remains in heat-seal position for a length of time sufficient to effect a complete bond between the leading and trailing ends of the spliced strips. The strip denoted 2 having almost run out, is now severed from the roll 1 to form a trailing end which passes from the blade 23 to the rollers 18 and 21; accordingly, the length of time for which the support 15 remains in heat-seal position is adjusted by timing means 29 interlocked to the blade 23 It will be seen from FIG. 5 that the blade 23 engages only one longitudinal edge of the strip 2, the subsequent tear being brought about through traction.

Figure 2:
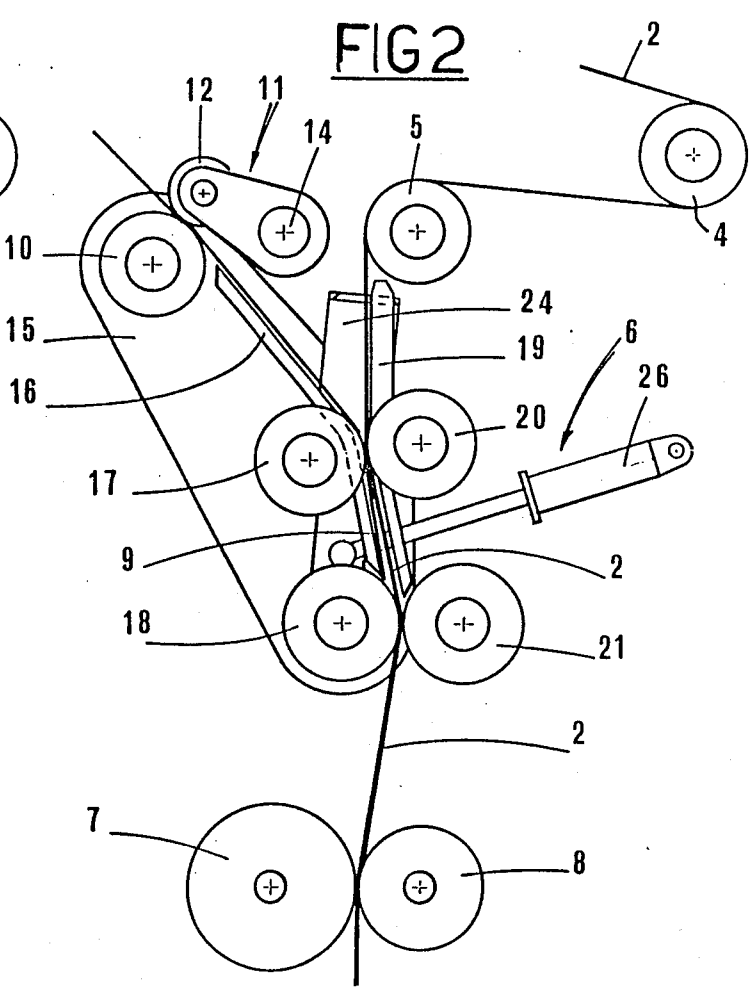
FIG. 2 is the same view as in FIG. 1, showing the device in its working position during the stage in which the two strips are bonded.

FIG. 2 illustrates the operation whereby the two ends are bonded, and the cut is made by the serrated blade 23.

Figure 3:
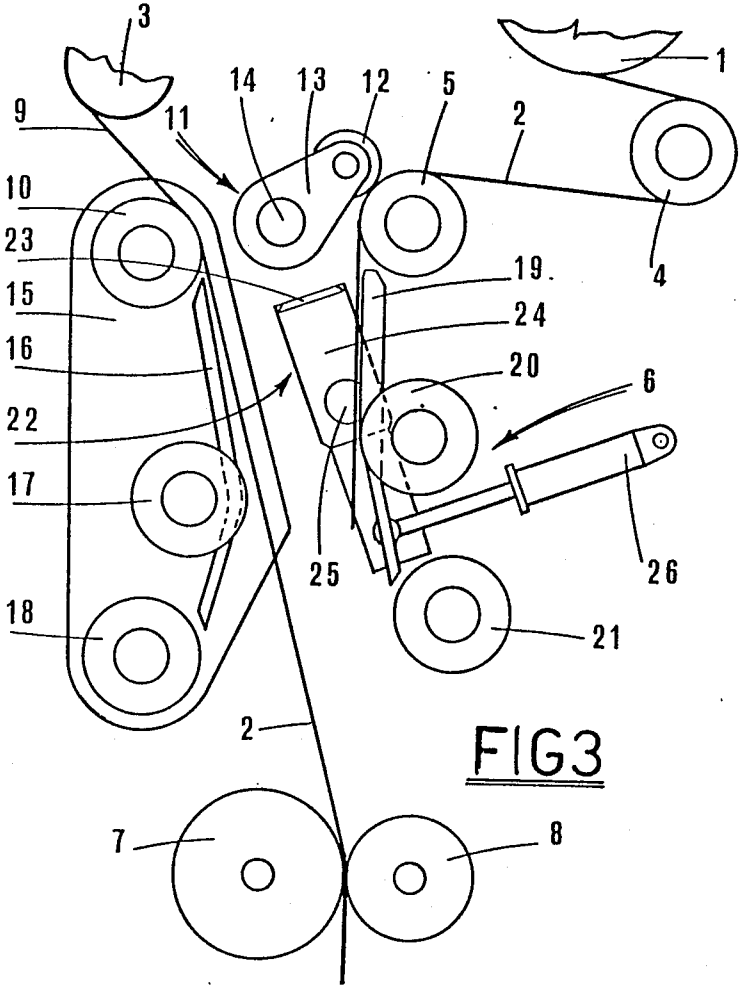
FIG. 3 is the same view as in FIG. 1, showing the device in the at rest position with the new roll supplying strip material to the packaging apparatus.

FIG. 3 shows the configuration of the device with the one strip 9 wound off steadily and supplied to the machine's packaging devices, and the remaining strip 2 awaiting the next splice, to be implemented once the strip 9 currently in use has almost run out; it will be noted that the sensing means 11 are rotated clockwise in relation to FIG. 1, with the wheel 12 engaging the respective drive roller 5.

When the strip 9 has almost completely run out, the transducer 27 will provide the signal to shift the support 15, bringing the pivoted plate 16 and rollers 17 and 18 into engagement with the fixed plate 19 and rollers 20 and 21, respectively.

Whichever roll 1 or 3 happens to be in current use, shift of the support 15 can occur only when enabled by the sensing means 11.

What is claimed is:

1. Apparatus for overlapping and splicing a moving leading end portion of a new strip of heat-sealable material being unwound from a new roll of such strip to a moving trailing end portion of an old strip of similar material being unwound from an old roll thereof, said apparatus comprising: pressure means through which overlapped end portions of the strips pass, said pressure means being heated and being operable to press together and bond the moving overlapping end portions of the strips; guide means for guiding said leading end portion of the new strip toward said pressure means; detecting means for detecting proximity of said leading end portion of the new strip moving along said guide means; means for operating said pressure means so as to press together and bond the moving overlapping end portions of the strips; cutting means located upstream of said guide means for cutting the old strip being unwound from the old roll to thereby form said trailing end portion of the old strip; and timing means for setting the operating time period of the pressure means according to the length of the trailing end portion of the old strip, as established by the cutting means, such that the pressure means presses and bonds the whole length of overlapping end portions of the strips.

2. Apparatus as in claim 1 wherein said pressure means includes a fixed roller and a roller mounted so as to be shiftable between an at-rest position in which the shiftable roller is spaced from the fixed roller and working position in which the shiftable roller contacts and is urged against the fixed roller, at least one of said rollers being heated.

3. Apparatus as in claim 1 wherein said guiding means includes a fixed guide plate, a guide plate mounted so as to be shiftable between an at-rest position in which the shiftable plate is spaced from the fixed plate and working position in which the shiftable plate is closely adjacent the fixed plate, a first guide roller carried by the fixed plate and a further guide roller carried by the shiftable plate such that in said working position of the shiftable plate the further guide roller contacts the first guide roller.

4. Apparatus as in claim 1 wherein said detecting means includes a wheel mounted for rotation on an arm, the arm being mounted for pivotal movement between two positions in one of which the wheel makes contact with the leading end portion of the new strip.

5. Apparatus as in claim 1 wherein said cutting means includes a serrated blade mounted for movement across only one longitudinal edge of the new strip and a double acting pressure cylinder assembly for moving the blade.

6. Apparatus for overlapping and splicing a moving leading end portion of a new strip of heat-sealable material being unwound from a new roll of such strip to a moving old strip being unwound from an old roll of such strip, said apparatus comprising: guide means operable for moving the leading end portion of the new strip into overlapping contact with the moving old strip; means upstream of said guide means, and operable after operation of said guide means, for cutting the moving old strip to thereby form a trailing end portion of the old strip, which trailing end portion then passes to said guide means which moves the trailing end portion into overlapping contact with the new strip; splicing means downstream of said guide means, through which splicing means the overlapped end portions of the strips pass, said splicing means including a heated bonding member and being movable between an at-rest position out of contact with the overlapped end portions of the strips and a working position in which the overlapped end portions of the strips are pressed together and bonded by the bonding member; and means responsive to operation of the cutting means for maintaining the splicing means in its working position for a length of time sufficient to ensure that the whole length of overlapped end portions of the strips are bonded together by said splicing means and for then moving the splicing means to its at-rest position.

7. Apparatus as in claim 6 including means for detecting a predetermined diminishing of the size of the old roll and means responsive to such detecting to operate said guide means.

* * * * *